US008011044B1

(12) United States Patent
Jones

(10) Patent No.: US 8,011,044 B1
(45) Date of Patent: Sep. 6, 2011

(54) PRESSURE RELIEVING BODY SUPPORT

(76) Inventor: George B. Jones, Fayetteville, NC (US)

( * ) Notice: Subject to any disclaimer, the term of this patent is extended or adjusted under 35 U.S.C. 154(b) by 0 days.

(21) Appl. No.: 12/710,402

(22) Filed: Feb. 23, 2010

(51) Int. Cl.
*A61H 23/02* (2006.01)

(52) U.S. Cl. ..... 5/653; 5/657; 5/612; 5/933; 297/284.3; 601/98; 601/100

(58) Field of Classification Search ..... 5/612, 244, 5/653, 657, 933, 934, 937; 601/98–100, 601/103; 297/284.3
See application file for complete search history.

(56) References Cited

U.S. PATENT DOCUMENTS 2,445,158 A 7/1948 Sparhawk ..... 5/60
2,773,498 A * 12/1956 Himmelman ..... 601/98
4,644,593 A * 2/1987 O'Brien ..... 5/613
5,109,558 A * 5/1992 Di Blasi ..... 5/611
5,626,555 A * 5/1997 Di Blasi et al. ..... 601/98
5,659,910 A 8/1997 Weiss ..... 5/618
5,862,550 A * 1/1999 Cosani ..... 5/612
6,557,937 B1 5/2003 Shah et al. ..... 297/284.3
6,799,342 B1 * 10/2004 Jarmon ..... 5/613

* cited by examiner

*Primary Examiner* — Michael Trettel

(57) ABSTRACT

A body support is provided utilizing a cushion formed in rectangular segments in which the segments alternately pivot to change pressure points on the surface of the user's skin. The body support can be used as a wheelchair seat cushion to prevent non-ambulatory patients from developing bedsores and other ailments. Electrical circuitry provided includes a timer to adjust the length of time between activation cycles thereby changing the pressure points at desired intervals.

10 Claims, 5 Drawing Sheets

PRESSURE RELIEVING BODY SUPPORT

FIELD OF THE INVENTION

The invention herein pertains to non-ambulatory patient body supports such as wheelchair seat cushions to prevent the development of bedsores and other ailments.

DESCRIPTION OF THE PRIOR ART AND OBJECTIVES OF THE INVENTION

In recent years healthcare costs have skyrocketed causing hospitals, rest homes and other medical facilities to minimize the number of health care workers employed and to reduce the hours worked, sometimes to the detriment of patients. While emergencies are generally promptly acted upon, more passive ailments are often times overlooked, eventually causing serious injuries to the patients. One of the main complaints of elderly patients and their families is the lack of activity provided for non-ambulatory patients. Such patients, whether sitting or laying in a bed require frequent movement to minimize and prevent bedsores and ulceration development. In the past nurses, orderlies and the like would visit patients on predetermined intervals to "walk" or "lift" and "turn" bed ridden patients to thereby change or relieve the pressure points on their skin. As patients do not usually have an immediate reaction to developing bedsores, this activity is often curtailed by medical personnel resulting in patient neglect.

Various devices in the past have been utilized to assist patients in preventing pressure related skin ulcerations such as shown in U.S. Pat. No. 2,445,158 of Sparhawk, U.S. Pat. No. 5,659,910 of Weiss and U.S. Pat. No. 6,557,937 of Shah et al. While all of the above included practices and equipment have been effective to some degree, there remains a need for an inexpensive, efficient and practical means for carrying out the repositioning and change of pressure points generally for non-ambulatory and immobile patients that must sit or lay for prolonged periods in one position.

Thus with the disadvantages of methods and equipment currently available, the present invention was conceived and one of its objectives is to provide a body support in the form of a segmented cushion for adaption to wheelchairs, beds, gurneys and the like to prevent bedsore development.

It is another objective of the present invention to provide a seat cushion which contains a series of first and second segments which provides alternate support for the body.

It is still another objective of the present invention to provide an undulating cushion which is driven by an electric motor joined to a housed camshaft having cams in different phases.

It is yet another objective of the present invention to provide a cost efficient body support which can be employed in wheelchairs, beds and otherwise by retrofitting conventional furniture and equipment.

Various other objectives and advantages of the present invention will become apparent to those skilled in the art as a more detailed description is set forth below.

SUMMARY OF THE INVENTION

The aforesaid and other objectives are realized by providing a cushion such as a seat cushion for a wheelchair which is divided into segments to allow the pressure points of a non-ambulatory patient positioned thereon to change at predetermined intervals. Generally, the cushion is divided into first and second segments which alternate by raising and lowering for supporting the patient's body. A camshaft contained within a housing attached to the wheelchair frame includes cams in different phases which are timed and motor driven. The cams are rotatable joined to cam followers which are affixed to lifts which respectively raise and lower the first and second segments during cycling. A standard timer allows the healthcare worker to regulate the time between activation cycles during which the first cushion segments move for example, from a lowered position upwardly into a support position with the second cushion segments and then the second cushion segments move from a contact or raised position downwardly into a non-contact position, completing an activation cycle. The camshaft turns one hundred eighty degrees (180°) during each activation cycle. At a later preset time, for example in thirty (30) minutes, the camshaft rotation begins anew and the second segments are raised into a coplanar relation with the first segments to support the body, and then the first segments are lowered away from the patient's body whereby only the second segments remain for support to thus change the pressure points experienced. As time passes depending on the timer setting, which may be five (5) minutes to two (2) hours, the first segments are then raised again into coplanar alignment with the second segments and the second segments are then retracted or lowered out of contact with the patient's body for another change in the pressure point contacts. The timer can be adjusted, depending on the frequency of change desired and the health, age and other conditions of the particular patient. The camshaft is driven by a chain drive connected to a 12 volt powered motor. A switch conveniently placed can be used by the healthcare worker or patient to activate cycling of the segmented cushion. The segmented cushion consists of alternating rectangular segments, for example twenty-five (25) segments are provided for a typical wheelchair seat with twelve (12) first segments and thirteen (13) second segments which as explained above alternate or pivot to provide a change in body support. A standard 12 volt storage battery supplies power to the motor over an extended period and a conventional recharging system can be applied to the battery as desired such as during hours of non-use.

Front and rear transverse members are attached to the wheelchair frame proximate the seat cushion to maintain and stabilize the frame of the wheelchair. An inner frame having two (2) transverse members and two (2) longitudinal members are affixed to the wheelchair frame beneath the seat to support the camshaft housing, battery, motor and other components. Although not described the device can be retrofitted for use in beds, gurneys and the like by modifying the frame described above and using more or less rectangular segments as needed.

DETAILED DESCRIPTION OF THE PREFERRED EMBODIMENT AND OPERATION OF THE INVENTION

Figure 1:
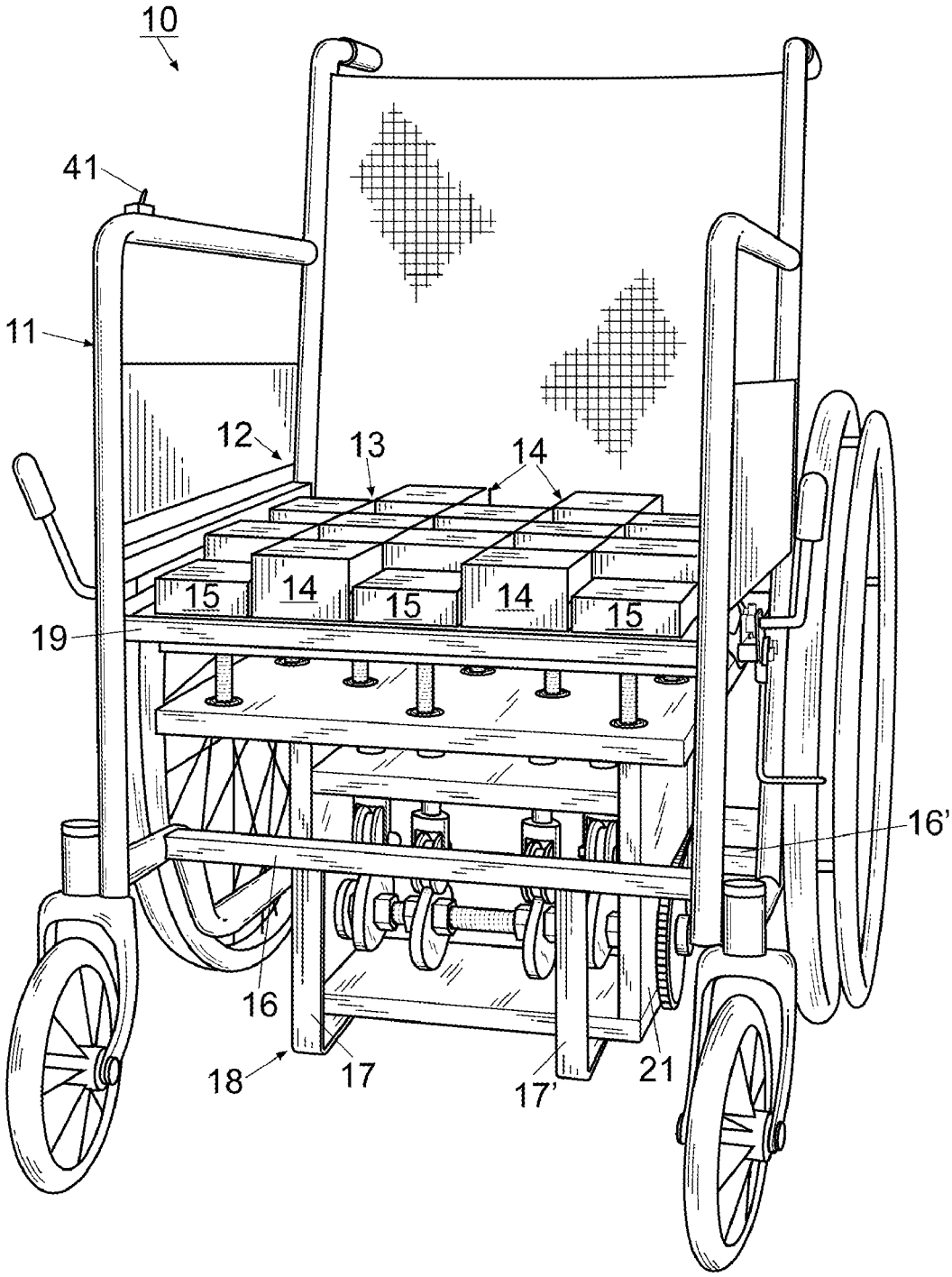
FIG. 1 shows a typical wheelchair which has been retrofitted with the seat cushion of the invention.
Figure 5:
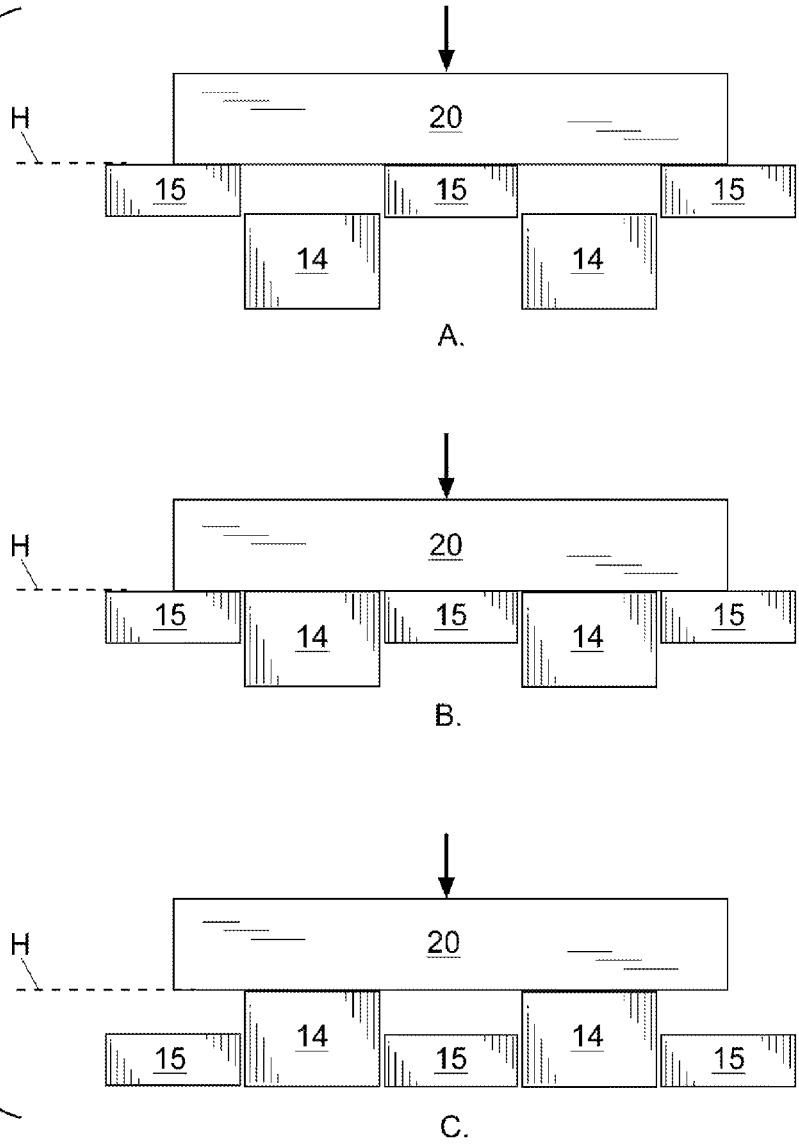
FIG. 5A shows a schematic front elevational view of the seat cushion seen in FIG. 1 with the second cushion segments supporting a load.
FIG. 5B demonstrates another phase of the schematic seat cushion with the first and second segments in coplanar alignment with each supporting the load.
FIG. 5C illustrates a later phase from that seen in FIG. 5B with only the first segments supporting the load.

For a better understanding of the invention and its operation, turning now to the drawings, FIG. 1 shows a typical body support in the form of preferred wheelchair 10. Wheelchair is substantially conventional in construction and being retrofitted with transverse members 19, 19', inner frame 18 and seat 12 which includes cushion 13 formed from a series of twenty-five (25) rectangular segments in rows, namely first segments 14 and second segments 15 which allow cushion 13 to move in an undulating fashion as first and second segments 14, 15 respectively raise and lower in an alternating fashion as schematically represented in FIGS. 5A-5C with load 20. Load 20 represents the weight of a patient or the like occupying seat 12 in wheelchair 10. Beds or other furniture could likewise be equipped as needed.

One (1) row of first and second segments 14, 15 of seat cushion 13 is seen schematically in FIG. 5A prior to activation of cushion 13 with first segments 14 having a height or thickness greater than second segments 15, approximately twice the height thereof. Load 20 is positioned on second segments 15 in FIG. 5A whereas in FIG. 5B load 20 is positioned on both segments 14 and 15 as first segments 14 have moved upwardly into coplanar alignment with second segments 15 during a cycle. In FIG. 5C second segments 15 are lowered completing the cycle whereby load 20 is now supported only by first segments 14. As shown, load 20 does not move or change its position relative to horizontal line H during the cycling or activation of cushion 13. Rather, horizontal line H remains at the same vertical position as first segments 14 and second segments 15 pivot thereto. Thus the height of a patient or other user of wheelchair 10 would remain at a relative stable vertical position without being lifted or lowered as first segments 14 and second segments 15 move into and out of coplanar relation. When the next cycle is activated first segments 14 will move downwardly as second segments 15 are raised upwardly whereby second segments 15 are again supporting load 20 as demonstrated in FIG. 5A.

Figure 2:
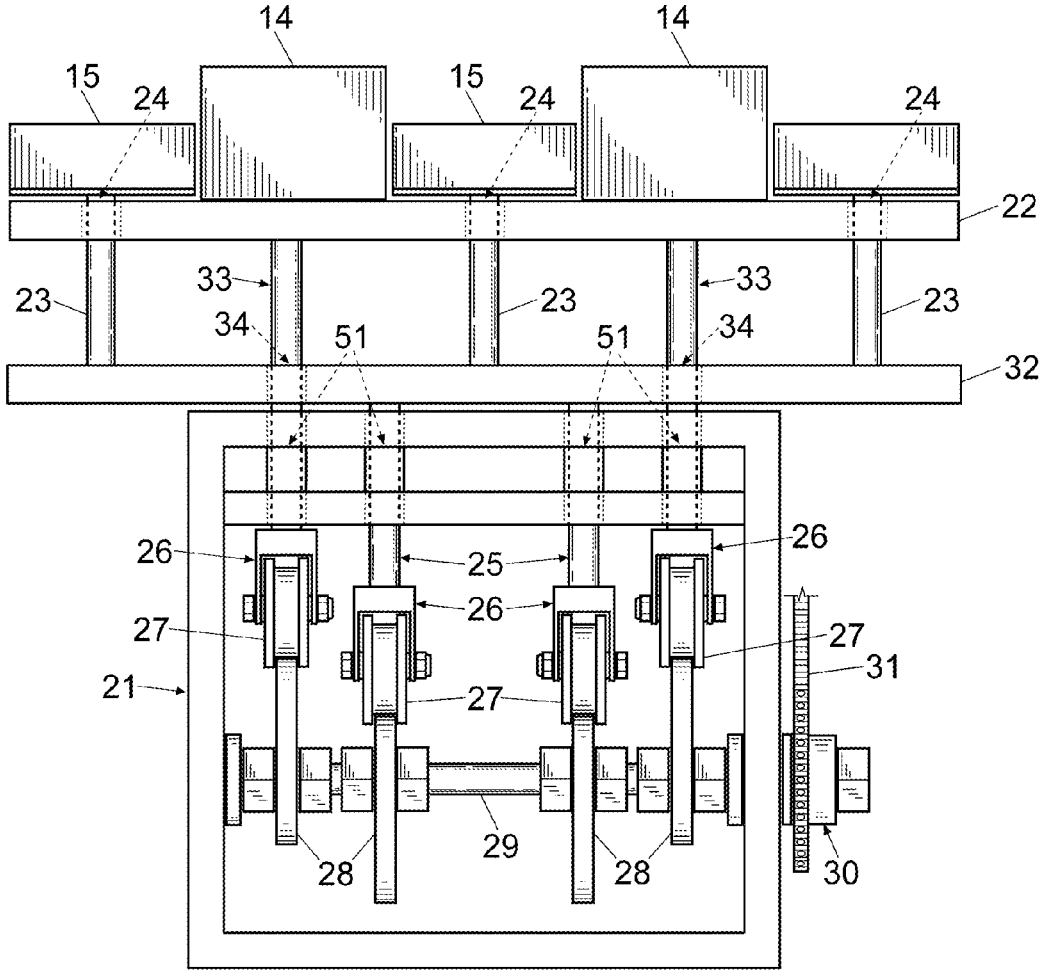
FIG. 2 demonstrates a schematic front view of the seat cushion segments as attached to the camshaft.

Cushion 13 is also schematically represented in a front view in FIG. 2 with first segments 14 being in a raised or upwardly position with second segments 15 in a lowermost position. First segments 14 are rigidly affixed to first base 22 whereas second segments 15 are rigidly affixed to second base 32 by steel rodules 23. Rodules 23 (thirteen (13) total—only three (3) shown) preferably are about one half inch (½") (1.27 cm) diameter steel and pass through apertures 24 in first base 22 and are affixed to second base 32. First base 22 and second base 32 are each formed from a rigid material, preferably five eighths inch (⅝") (1.58 cm) plywood although other suitable materials may be used. First and second segments 14, 15 are preferably formed from a conventional resilient neoprene rubber of sufficient density to insure comfort of the user and may be covered with a polymeric fabric (not shown) as desired.

Figure 3:
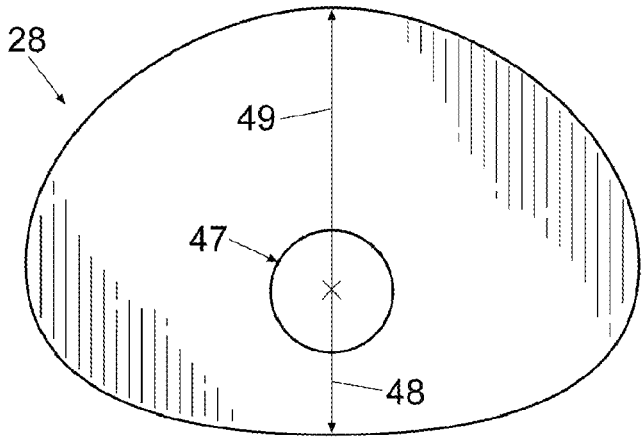
FIG. 3 pictures a side view of one of the four identical camshaft cams.
Figure 4:
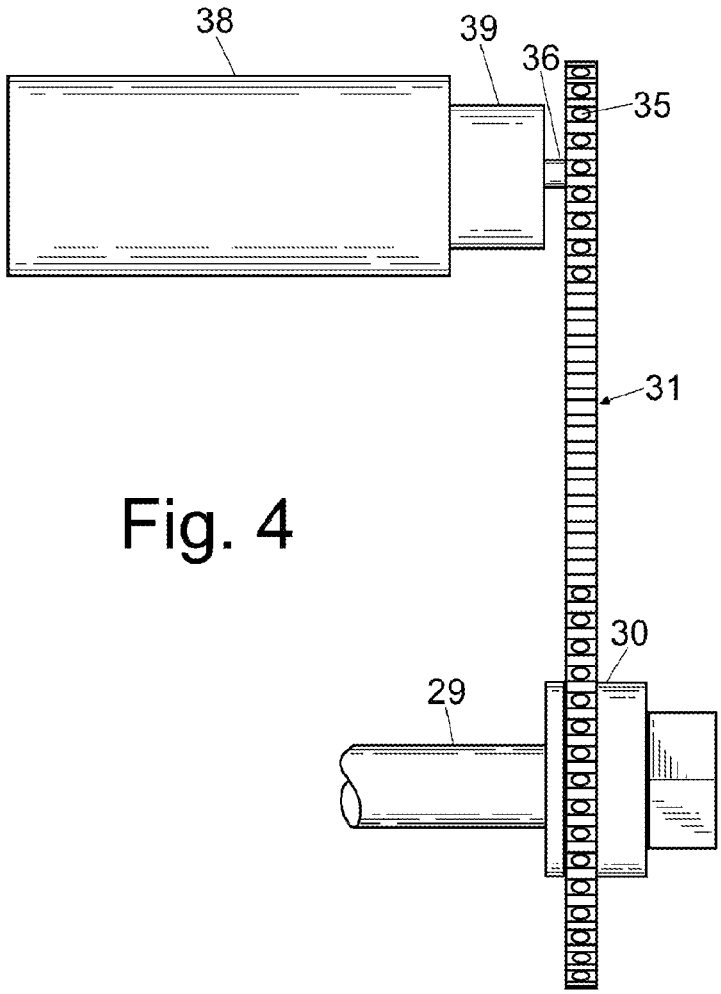
FIG. 4 illustrates a schematic representation of the motor and chain affixed to the camshaft sprocket.

As also shown in FIG. 2 a pair of rods 33 connect directly to first base 22 and pass through apertures 34 of second base 32 and apertures 51 of camshaft housing 21. Each rod 33 is fitted with cam follower 26 which includes wheel 27 which is grooved to accommodate and ride cam 28 (FIG. 3) on camshaft 29 which are housed within camshaft housing 21. A pair of rods 25 pass through apertures 51 of camshaft housing 21 and connect directly to second base 32. Rods 25 are each likewise fitted with cam followers 26, wheels 27 and cams 28. Cams 28 are somewhat oval having short lobes 48 and long lobes 49 as shown in FIG. 3 and are rigidly affixed to camshaft 29 which in turn is joined to cam sprocket 30. Cams 28 are formed preferably from stainless steel and each includes an aperture 47 for receiving camshaft 29. As shown schematically in FIG. 4, cam sprocket 30 affixed to camshaft 29 is driven by standard endless link chain 31 which is affixed to gear 35. Gear 35 is positioned on shaft 36 which is turned by motor 38 and transmission 39 which consist of a typical 12 volt electric winch. Motor 38 is preferably one quarter (¼) horsepower.

Figure 6:
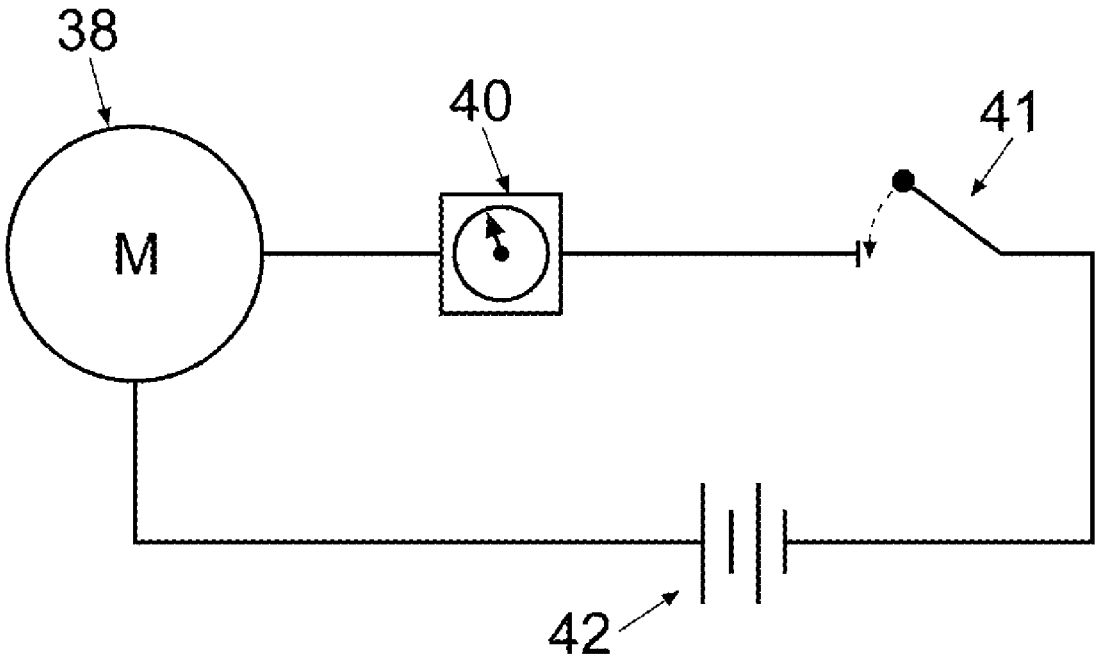
FIG. 6 depicts a schematic of certain of the electrical components of the invention.

In FIG. 6 an electrical schematic diagram is seen with motor 38, timer 40, switch 41 and battery 42. Timer 40 is a standard commercial timer with time ranges which can be manually preset from a few seconds up to two (2) hours. Timer 40 controls the length of time between activation cycles of cushion 13. By manually setting timer 40 at thirty (30) minutes, motor 38 will activate at thirty (30) minute intervals for a half revolution of camshaft 29 whereby cushion segments 14 and 15 will complete one (1) cycle such as demonstrated in FIGS. 5A-5C. More or less cycle frequencies per time can be set by adjusting timer 40, depending on the particular patient's needs. For example, a more elderly patient who is more susceptible to bedsores may require five to ten (5-10) minute apart cycles whereas a younger more healthy patient may require only cycles at one (1) hour intervals as directed by a physician or healthcare personnel. Switch 41 is a typical toggle switch which can be located in a convenient site such as shown in FIG. 1 to turn on and off the power to battery 42, motor 38 and timer 40.

Standard wheelchair frame 11 as shown in FIG. 1 has been modified to include front and rear transverse members 19, 19' to stabilize and support wheelchair frame 11. Transverse members 19, 19' (19' not shown) are ½" (1.27 cm) tubular steel stock and are welded to frame 11 proximate seat 12. Inner frame 18 includes transverse members 16, 16' and longitudinal members 17, 17' which are also formed from steel to support camshaft housing 21, motor 38, battery 42 and other components of seat 12 as previously described. Transverse members 16, 16' are rigidly affixed to wheelchair frame 11 and longitudinal members 17, 17' are each rigidly affixed respectively to transverse members 16, 16'. Camshaft housing 21 is affixed to inner frame 18 and can be formed from plywood or other similar materials to enclose camshaft 29, cams 28 and respective components as seen in FIG. 2.

The method of using body support wheelchair 10 consists of patient (not seen) placement on cushion 13 of seat 12. Next, timer 40 is set for appropriate cycle activation such as in the range of five (5) minutes to one (1) hour between each cycle. Thereafter, switch 41 is turned on whereby battery 42 powers timer 40, motor 38 and transmission 39 which rotates endless link chain 31 thereby rotating camshaft 29, cams 28, rods 33, 25 and first and second segments 14, 15 to complete a cycle. Thereafter the cycles will continue at predetermined time intervals by timer 40 until switch 41 is turned off. Activation cycles are completed as needed and at the end of the day the patient can then be removed from wheelchair 10 and examined for bedsores and the like. Thereafter, as the patient next uses wheelchair 10 the activation cycles can be adjusted as needed for relieving pressure for the prevention of bedsores and the like.

The illustrations and examples provided herein are for explanatory purposes and are not intended to limit the scope of the appended claims.

I claim:

1. A body support for relieving pressure comprising: a cushion, said cushion comprising a plurality of first and second segments, said plurality of first segments contiguous said plurality of second segments, said plurality of first segments each having a height greater than each of said plurality of second segments, a first base, said plurality of first segments each rigidly affixed to said first base, a second base, said plurality of second segments each rigidly affixed to said second base and contiguous said first base, a plurality of rodules, each of said plurality of rodules rigidly affixed to said second base and to different ones of said plurality of second segments, said first base movable relative to said second base whereby said second base can be directed toward said first base to bring said plurality of second segments into coplanar alignment with said plurality of first segments.

2. The body support of claim 1 wherein said first base defines a plurality of rodule apertures, said plurality of rodules each positioned in different ones of said first base rodule apertures.

3. The body support of claim 1 further comprising a cam assembly, said cam assembly comprising a camshaft, cams, said cams attached to said camshaft, a pair of lifts, each of said pair of lifts engaging different ones of said cams, one of said pair of lifts attached to said first base and the other of said pair of lifts attached to said second base.

4. The body support of claim 3 wherein said cams are mounted out of phase on said camshaft.

5. The body support of claim 3 wherein said pair of lifts each comprise rod, a follower, said follower pivotally mounted on said rod.

6. The body support of claim 3 further comprising a sprocket, said sprocket attached to said camshaft, a chain, a motor, a gear, said gear affixed to said motor, said chain attached to said gear and to said sprocket to allow said motor to power said camshaft.

7. A body support for relieving pressure comprising: a cushion, said cushion comprising first and second segments, said first segments contiguous said second segments, said first segments each having a height greater than each of said second segments, a first base, said first segments each rigidly affixed to said first base, a second base, said second segments each rigidly affixed to said second base, said second segments each contiguous said first base, said first base movable relative to said second base whereby said second base can be directed toward said first base to raise said second segments into coplanar alignment with said first segments, a cam assembly, said cam assembly comprising a camshaft, a plurality of cams, said plurality of cams attached to said camshaft, a pair of lifts, each of said pair of lifts engaging different ones of said plurality of cams, each of said pair of lifts comprising a rod, a follower, said follower pivotally mounted on said rod, one of said pair of lifts attached to said first base and the other of said pair of lifts attached to said second base.

8. The body support of claim 7 further comprising a sprocket, said sprocket attached to said camshaft, a chain, a motor, a gear, said gear affixed to said motor, said chain attached to said gear and to said sprocket to allow said motor to power said camshaft.

9. The body support of claim 8 further comprising a battery, a switch, said switch attached to said motor and to said battery.

10. The body support of claim 9 further comprising a timer, said timer connected to said switch.

* * * * *